US009060225B2

(12) United States Patent
Cheng

(10) Patent No.: US 9,060,225 B2
(45) Date of Patent: Jun. 16, 2015

(54) WIRELESS EARPHONE

(71) Applicant: DEXIN CORPORATION, New Taipei (TW)

(72) Inventor: Wang Dong Cheng, New Taipei (TW)

(73) Assignee: DEXIN CORPORATION, New Taipei (TW)

( * ) Notice: Subject to any disclaimer, the term of this patent is extended or adjusted under 35 U.S.C. 154(b) by 361 days.

(21) Appl. No.: 13/744,168

(22) Filed: Jan. 17, 2013

(65) Prior Publication Data

US 2014/0198927 A1 Jul. 17, 2014

(51) Int. Cl.
*H04R 1/10* (2006.01)
*H04R 5/02* (2006.01)

(52) U.S. Cl.
CPC ..... *H04R 1/1033* (2013.01); *H04R 1/1016* (2013.01); *H04R 2420/07* (2013.01)

(58) Field of Classification Search
CPC . H04R 1/1033; H04R 1/1016; H04R 2420/07
USPC ..... 381/74, 300, 309
See application file for complete search history.

(56) References Cited

U.S. PATENT DOCUMENTS

2014/0185820 A1* 7/2014 Cataldo et al. ..... 381/74

FOREIGN PATENT DOCUMENTS

| | | |
|---|---|---|
| TW | 510356 | 11/2002 |
| TW | M256036 | 1/2005 |
| TW | M263681 | 5/2005 |
| TW | I285184 | 8/2007 |
| TW | M321426 | 11/2007 |
| TW | M324056 | 12/2007 |

* cited by examiner

*Primary Examiner* — Vivian Chin
*Assistant Examiner* — Ammar Hamid
(74) *Attorney, Agent, or Firm* — Li & Cai Intellectual Property (USA) Office

(57) ABSTRACT

A wireless earphone comprises a fixing module including a lower cover and a fixing element disposed at the center thereof; a rotating case having a rotating base and an upper cover fixed to the rotating base, the rotating base includes a cup portion and an annular plate extending therefrom, the fixing element passes through the cup portion, and the rotating case rotates about the fixing element; an electronic module disposed between the upper cover and the rotating base; a tape spring having one end attached to the cup portion and the other end to the fixing element; at least one earphone cable wound around the cup portion having one end connected to the circuit board and the other end passing through the lower cover; and a fastening module disposed between the rotating base and the lower cover, for retaining the relative position there-between.

14 Claims, 6 Drawing Sheets

WIRELESS EARPHONE

BACKGROUND OF THE INVENTION

1. Field of the Invention

The present disclosure relates to a wireless earphone; in particular, to a wireless earphone with bidirectional reeling that is wirelessly connectable to an electronic device for sending and receiving sound signals to and from the same.

2. Description of Related Art

Nowadays, many people have at least one portable electronic device such as cell phone, laptop, hand held video game device, etc. People can use these devices anywhere anytime, whether to play games, listen to music or making a call. Most people use earphones when listening to music or making calls in order to avoid inconveniencing others. However the cables connecting the earphones to these devices are inconvenient to store, and the tugging involved can cause damages to the earphones or the devices.

Patent TW M256036 provides a wireless earphone which uses an ear loop to suspend the wireless earphone on the ear of the user. This design provides only a single earpiece to be applied on a single ear for listening, and the weight of the earpiece is supported by the single ear which can result in discomfort.

A conventional bidirectional reeling device as disclosed in Patent TW 1285184 uses a coil spring as a restoring force, and dual cables wound around the reel in opposite directions, as a method for convenient extracting and storage of the cables. A protruding part and a stopping element provide a fastening solution. Traditional fastening solutions for cables such as those shown in Publications TW 510356, M263681, M321426, and M324056 use ratchet, combination of toggle piece with track, and steel ball as fastening solution for the reel. However, if circuit boards and wires are to be installed in the above mentioned reels, rotation of some of the parts may cause tugging of cables and connection failures.

Therefore, the inventor believes the above mentioned structures can be improved upon, and through many years of experience, careful observation and research, combined with application of theory, has proposed the present disclosure which reasonably and effectively improves upon the above mentioned deficiencies.

SUMMARY OF THE INVENTION

The object of the present disclosure is to provide a wireless earphone with bidirectional reeling and minimal undesired tugging of cables.

In order to achieve the aforementioned objects, the present disclosure provides a wireless earphone, which includes a fixing module, a rotating case, an electronic module, a helical torsion spring (tape spring), at least one earphone cable and a fastening module. The fixing module includes a lower cover and a fixing element. The fixing element is disposed at the center of the lower cover. The rotating case includes a rotating base and an upper cover. The upper cover is fixed on the rotating base. The rotating base has a cup portion and an annular plate extending from the top edge of the cup portion. The fixing element passes through the cup portion. The rotating case is pivoted on the fixing column. The electronic module includes a circuit board, a transceiver chip, and a battery. The electronic module is disposed between the top cover and the rotating base and is fixed on the annular plate. The coil spring is disposed inside the cup portion, with one end attached to the cup portion and the other end attached to the fixing element. The earphone cable is wound around the cup portion. One end of the earphone cable is fixed to the cup portion, and extends to connect to the circuit board. The other end of the earphone cable passes through the lower cover. The fastening module is disposed between the rotating base and the lower cover, such that the rotating case is relatively fixed to the fixing module.

According to an embodiment of the present disclosure, each of the cup portion and the annular plate has a cable aperture through which the earphone cable can pass through and connect to the circuit board.

The advantage of the present disclosure lies in that the electronic module is disposed on the rotating case to prevent tangling of cables and poor contact. The cable aperture of the present disclosure and its corresponding cable arrangement improves the storage solution of the earphone cables.

In order to further the understanding regarding the present disclosure, the following embodiments are provided along with illustrations to facilitate the disclosure of the present disclosure without limiting the same.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
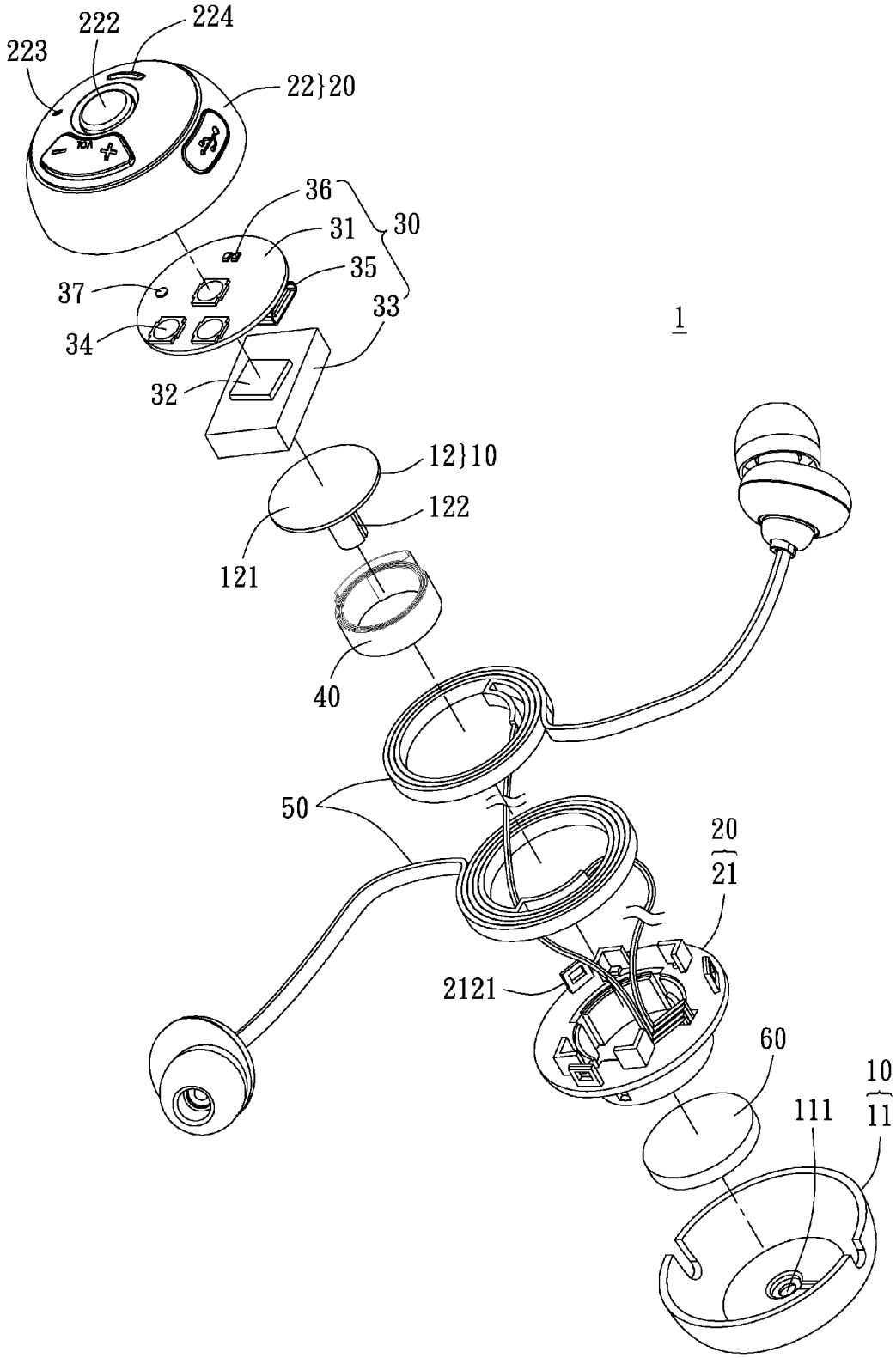
FIG. 1 shows a perspective exploded diagram of a wireless earphone of the present disclosure.

FIG. 1 is a schematic exploded diagram of a wireless earphone 1 of the present disclosure. The present disclosure provides a wireless earphone 1, which has a fixing module 10, a rotating case 20, an electronic module 30 disposed on the rotating case 20, a tape spring 40, an earphone cable 50 wound around the rotating case 20, and a fastening module 60 disposed between the fixing module 10 and the rotating case 20. One end of the tape spring 40 is attached to the fixing module 10, and the other end is attached to the rotating case 20.

As shown in FIG. 1, the fixing module 10 includes a lower cover 11 and a fixing element 12. The outer surface of the lower cover 11 can have a clip (not shown in the figure), to be clipped on clothes, bags and such when the user is walking or exercising, so that the user does not have to employ a hand to hold the wireless earphone 1. In the present embodiment, the fixing element 12 is a fixing column 12, which has an engagement groove 122 (refer to FIG. 2). The lower cover 11 is bowl-shaped, and has a fixing aperture 111 at its center position. The fixing aperture 111 roughly has the same diameter as the fixing column 12 does, such that an end of the fixing column 12 is disposed in the fixing aperture 111. The fixing column 12 can be fixed to the fixing aperture 111 by screws, engagement, or other methods not limited herein. In the present embodiment as shown in FIG. 2, the fixing module 10 further has a round plate 121 positioned at the other end of the fixing column 12, also the opposite end of the lower cover 11.

Figure 2:
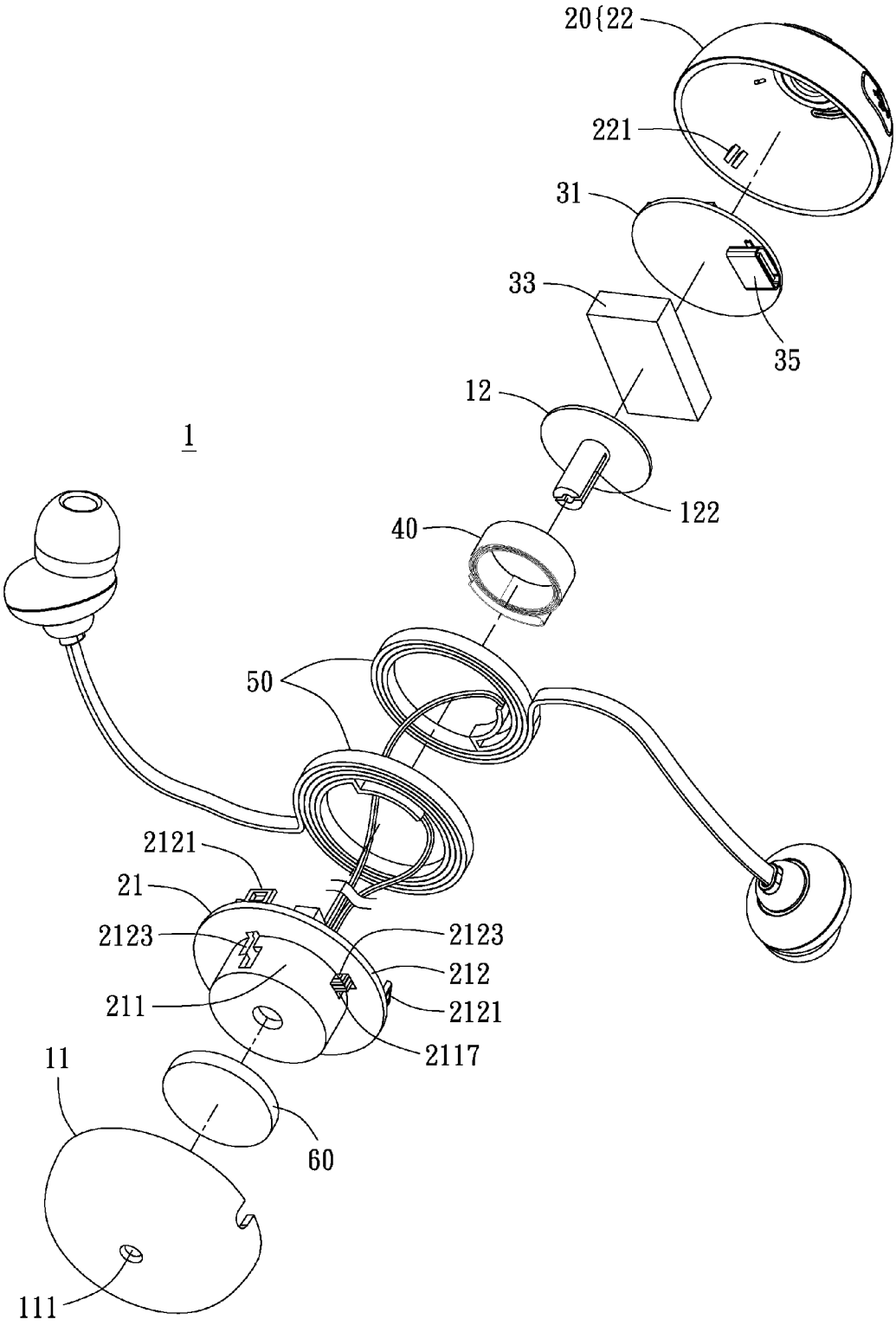
FIG. 2 shows a perspective exploded diagram of a wireless earphone of the present disclosure from another point of view.
Figure 3:
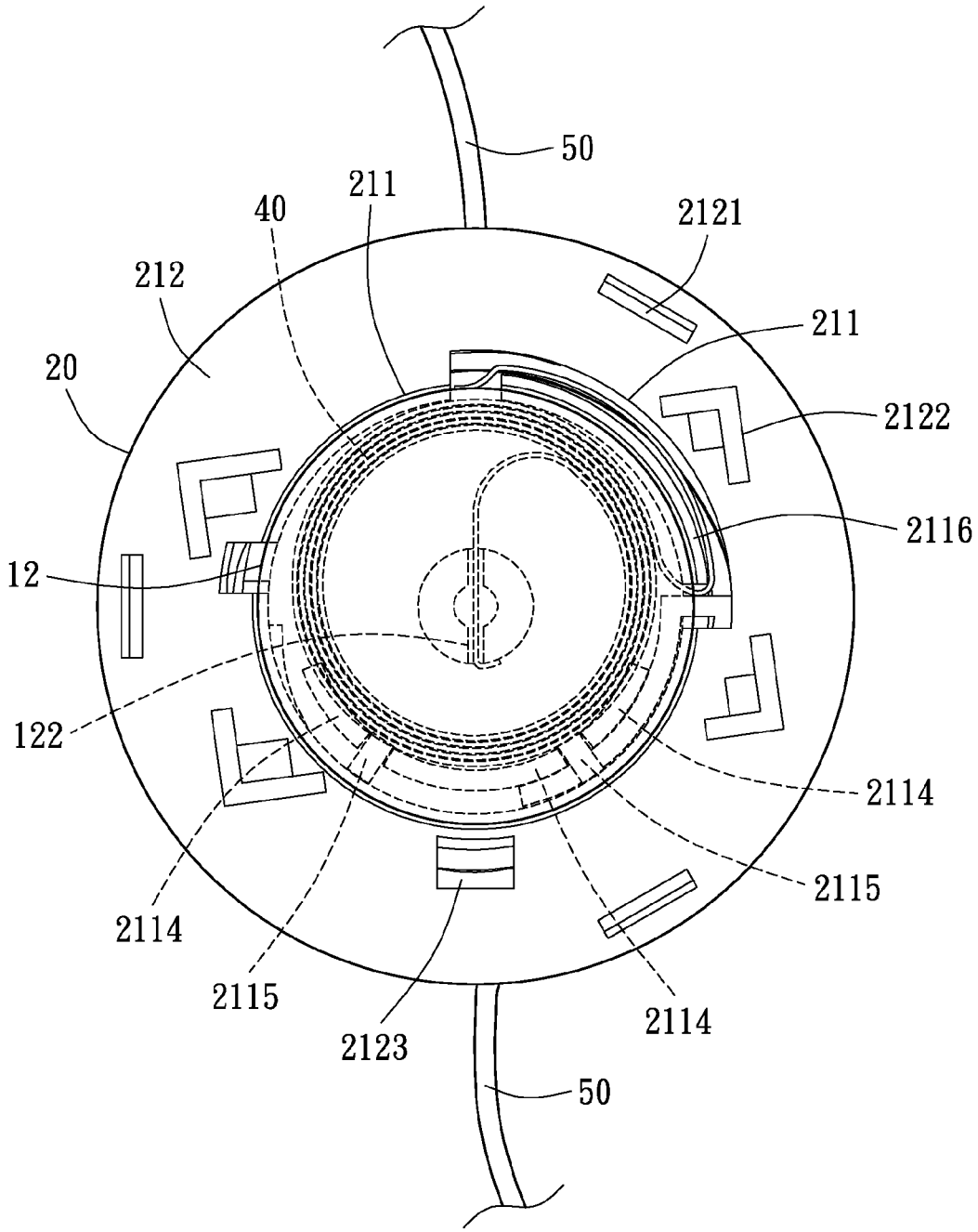
FIG. 3 shows a perspective assembly diagram of a rotating case, a tape spring, and an earphone assembly of a wireless earphone of the present disclosure.
Figure 4:
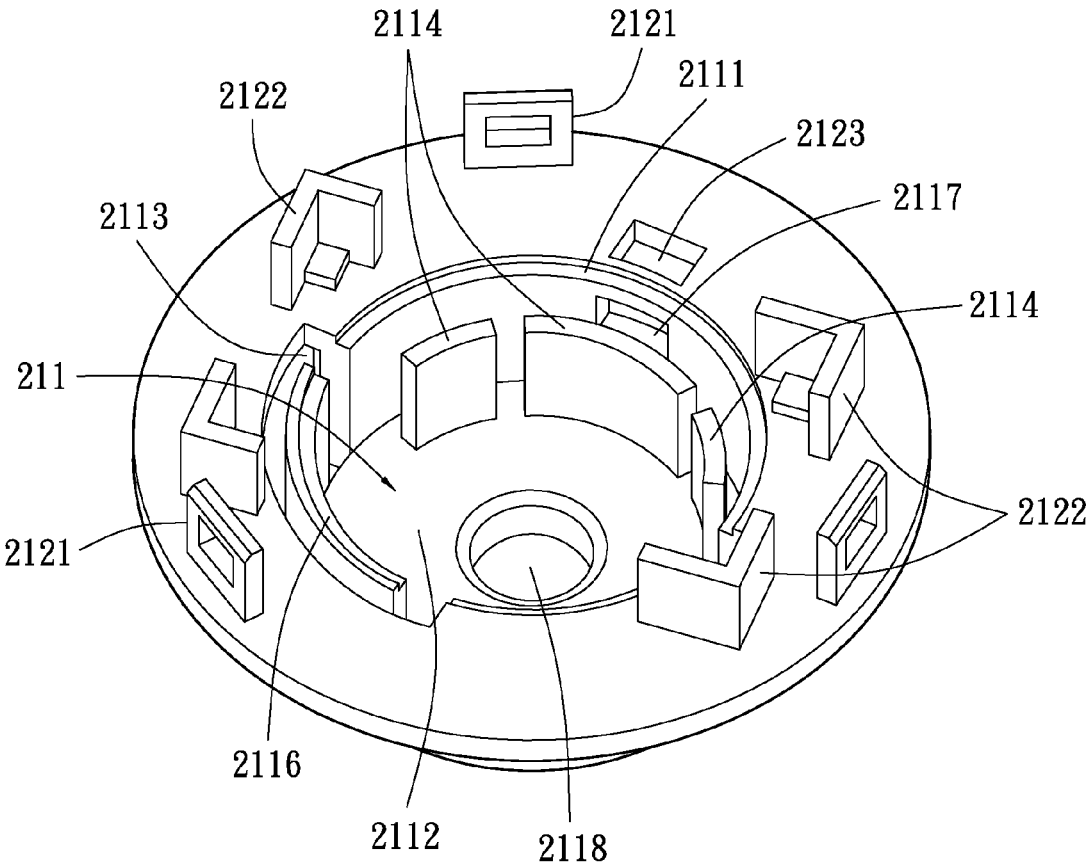
FIG. 4 shows a perspective diagram of a rotating case of a wireless earphone of the present disclosure.
Figure 5:
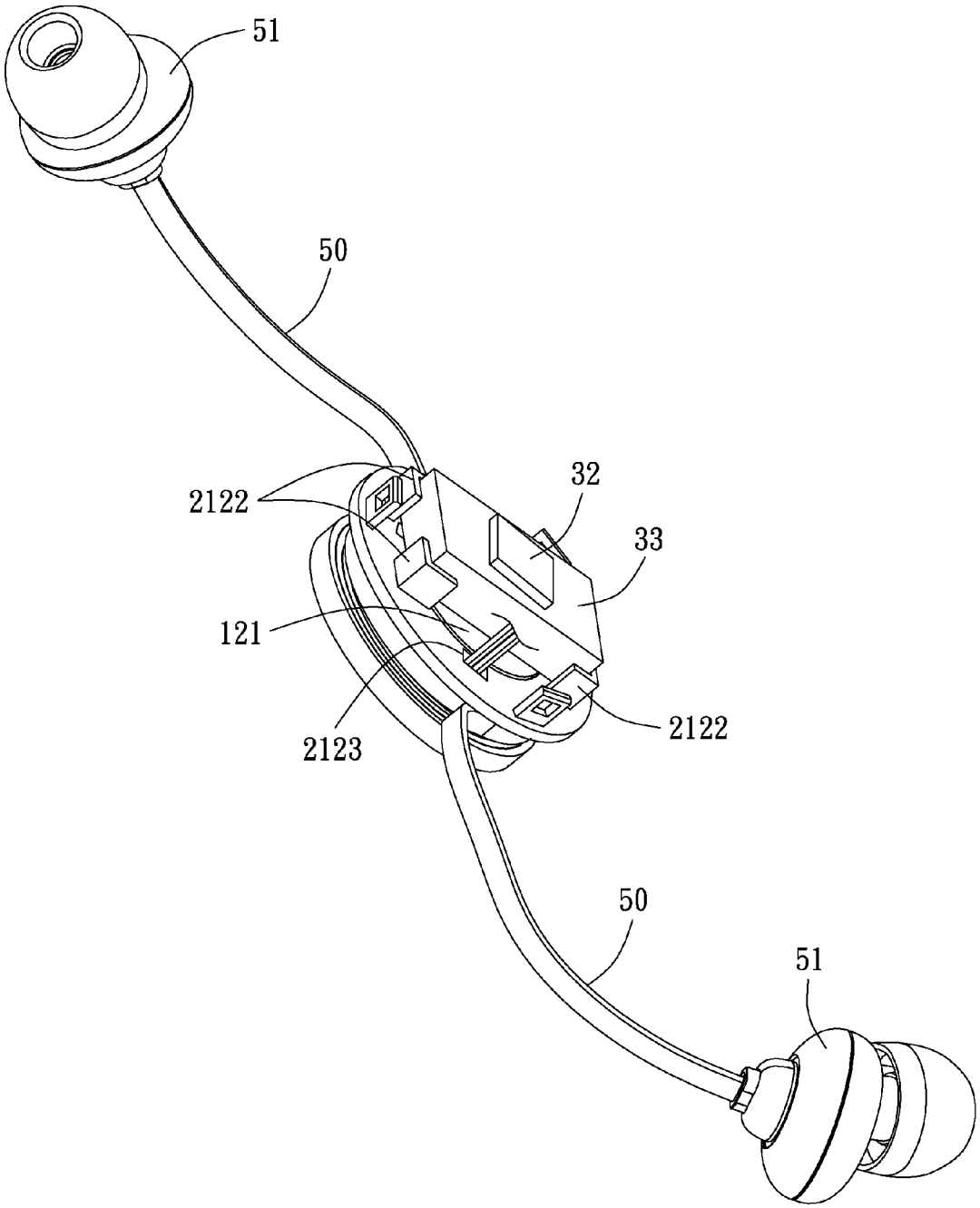
FIG. 5 is a perspective partial assembly diagram of a wireless earphone of the present disclosure.

As shown in FIG. 2, the rotating case 20 has a rotating base 21 and an upper cover 22. The upper cover 22 is fixed to the rotating base 21. As shown in FIG. 2 and FIG. 3, the rotating base 21 has a cup portion 211 and an annular plate 212. The annular plate 212 is extended from the top edge of the cup portion 211. As shown in FIG. 3 and FIG. 4, multiple first latches 2121 are evenly spaced on the annular plate 212. As shown in FIG. 5, the inner edge of the annular plate 212 (also the top end of the cup portion 211) has a diameter roughly equal to that of the round plate 121, such that the round plate 121 can be disposed on top of the cup portion 211, to protect and keep out the dust from the module inside the cup portion 211. Furthermore, multiple battery bases 2122 and a cable aperture 2123 are disposed on the annular plate 212 (shown in FIG. 2).

As shown in FIG. 2 and FIG. 3, multiple second latches 221 are disposed on the upper cover 22 corresponding to the first latches 2121. The first latches 2121 and the second latches 221 are male and female latches for engaging with each other. In the present embodiment, the first latches 2121 are frame-shaped, and the second latches 221 are protruding-shaped. The protruding structures engage with the frame-shaped structures, such that the upper cover 22 and the rotating base 21 can be fixed by the engagement of the first latches 2121 with the second latches 221. As shown in FIG. 1, multiple keys 222, a sound receiving aperture 223, and a light passing aperture 224 are disposed on the upper cover 22. The keys 222 can control the volume, select songs, turn the device on and off, etc. A transparent glass (not shown in the figure) can be disposed at the light passing aperture 224. The upper cover 22 can have a display board (not shown in the figure) to display information on the song being played.

As shown in FIG. 3 and FIG. 4, the cup portion 211 has a lateral wall 2111 and a bottom face 2112. Multiple openings 2113 and a cable aperture 2117 are disposed on the lateral wall 2111. Three protruding pieces 2114, two fixing units 2115, and an engagement piece 2116 are disposed at the bottom face 2112. A round aperture 2118 is disposed at the center of the bottom face 2112. The fixing column 12 can pass through the round aperture 2118, such that the cup portion 211 can be disposed inside the lower cover 11, and the rotating case 20 can rotate about the fixing column 12. The protruding pieces 2114 and the lateral face wall 2111 have a fixed gap between them. The fixing units 2115 are engaged between multiple protruding pieces 2114. One end of each of the fixing units 2115 abuts the lateral wall 2111. The engagement piece 2116 and the lateral wall 2111 have a fixed distance between them. The amounts of the protruding piece 2114, the fixing unit 2115 and the engagement piece 2116 are not limited herein.

As shown in FIG. 1, the electronic module 30 includes a circuit board 31, a transceiver chip 32, a battery 33, a micro switch 34, an electrical connector 35, a lighting unit 36, and a microphone 37. As shown in FIG. 1 and FIG. 5, the battery 33 is disposed on the battery base 2122 of the annular plate 212. The circuit board 31 is electrically connected to the battery 33. The transceiver chip 32 is disposed between the circuit board 31 and the battery 33. The micro switch 34, the lighting unit 36 and the microphone 37 are disposed on the circuit board 31 at the face facing the upper cover 22 such that the key 222 correspond to the micro switch 34 so that when a user presses the key 222 the micro switch 34 is triggered to transmit command signals. The lighting unit 36 corresponds to the light passing aperture 224, for providing lighting to notify the user of the status of the wireless earphone 1. The microphone 37 corresponds to the sound receiving aperture 223, for recording the user's voice. The electrical connector 35 is disposed on the other face of the circuit board 31, able to charge the battery 33 and transmit signals to the wireless earphone 1. This structure can be utilized to make the electronic module 30 rotate along with the rotating case 20. In the present disclosure, the transceiver chip 32 is a Bluetooth chip, and the lighting unit 36 is an LED light.

As shown in FIG. 3, the tape spring 40 is wound around the fixing column 12, and partially disposed between the engagement piece 2116 and the lateral wall 2111. One end of the tape spring 40 is attached to one side of the engagement piece 2116, and the other end of the tape spring 40 is fixed to the engagement groove 122 of the fixing column 12, such that the tape spring 40 extends or contracts to provide a restoring force to the rotating case 20 as the latter rotates.

Figure 6:
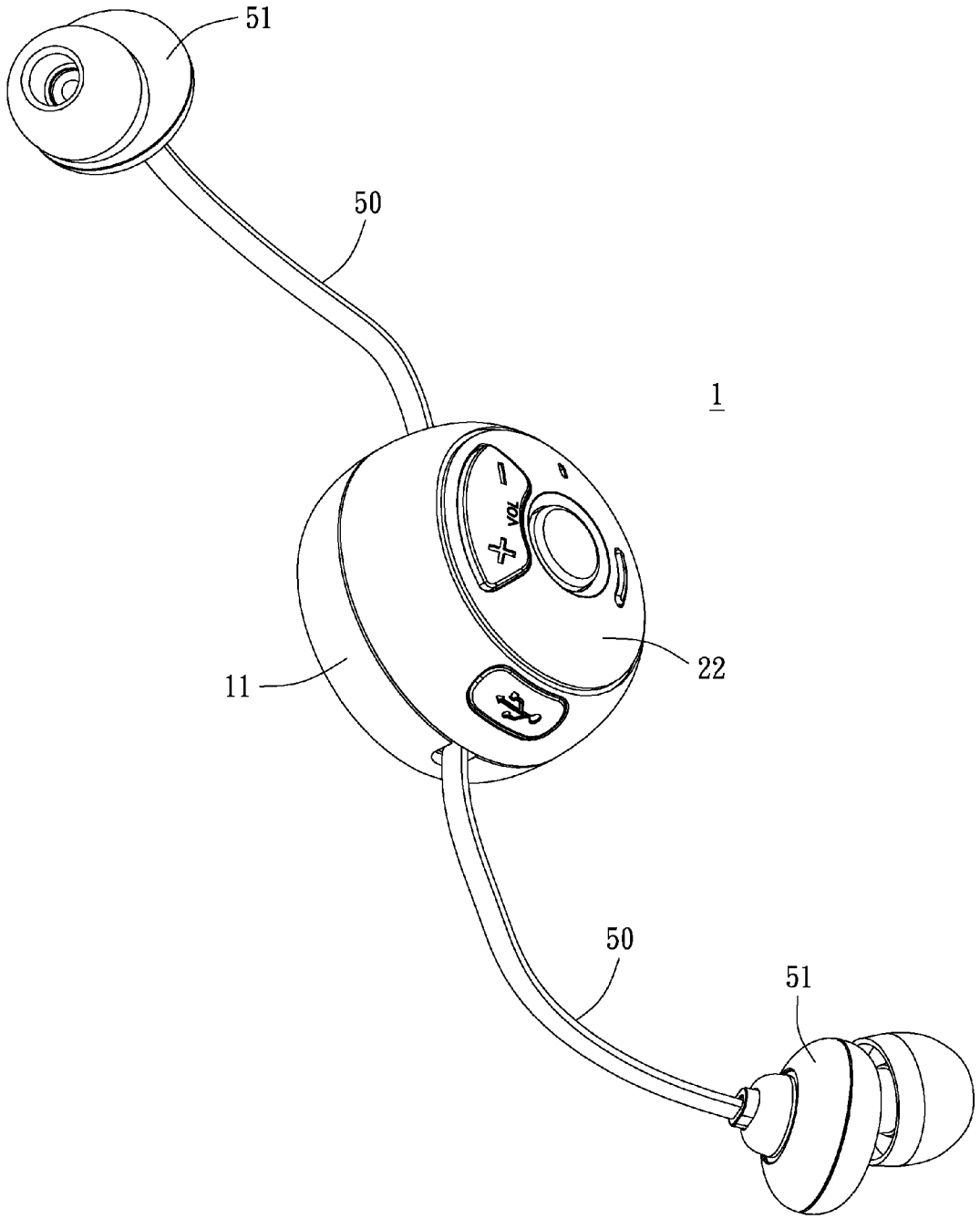
FIG. 6 is a perspective diagram of a wireless earphone of the present disclosure.

As shown in FIG. 5, the earphone cable 50 can be a left earphone cable or a right earphone cable, respectively wound around the cup portion 211 in a clockwise and counter-clockwise direction. As shown in FIG. 2, FIG. 3 and FIG. 5, one end on each of the left and right earphone cables respectively pass through different openings 2113, such that the earphone cables 50 can be partially accommodated between the protruding piece 2114 and the lateral wall 2111, and be fixed to the fixing unit 2115. Multiple cables extend from the earphone cables 50. In the above mentioned state of the cables, the earphone cables 50 pass through the cable aperture 2117 of the lateral wall 2111 and the cable aperture 2123 on the annular plate 212, extend toward the upper cover 22 and connect to the circuit board 31. As shown in FIG. 6, the other end of cables 50 pass through the lower cover 11 and have a speaker part 51. The speaker part 51 can also be replaced by a microphone (not shown in the figures). This structural configuration allows both the left and right earphone cables to simultaneously be extended or contracted, and drives the cup portion 211 to rotate about the fixing column 12 when extending, further rotating the rotating case 20 and the electronic module 30. Furthermore, when the earphone cables 50 do not have precise lengths, the method of passing the above mentioned earphone cables 50 through the cable apertures 2117 and 2123 provides a storage solution for neatly storing extra lengths of the earphone cables 50, especially relative to the method of connecting the earphone cables 50 directly to the circuit board 31.

As shown in FIG. 1, the fixing module 60, which can be the ratchet, combination of toggle piece with track, or steel ball mentioned in the description of related art, is disposed between the rotating base 21 and the lower cover.

As shown in FIG. 3, as mentioned above, when the user pulls on the earphone cable 50, the rotating case 20 rotates about the fixing column 12 and extends or contracts the tape spring 40, therefore the tape spring 40 will apply a restoring force. Even when the user is no longer applying force on the earphone cables, the rotating case 20 is subject to the restoring force of the tape spring 40, and rotates back to its original position relative to the fixing module 10, such that the earphone cable 50 does not expose a certain length outside the lower cover 11. The fastening module 60 fixes the rotating case 20 to a determined position relative to the fixing module 10, such that the user can decide how much of the earphone cables 50 are exposed outside the lower cover 11. Moreover, when the earphone cables 50 are pulled to the end, the restoring force of the tape spring 40 rotates the rotating case 20 back to its original position, retracts the earphone cables 50 such that most of the earphone cables 50 are wound around the cup portion 211 and not exposed outside the lower cover 11, thereby preventing the earphone cables 50 from tangling or being damaged due to tugging.

In summary of the above, the present disclosure has the following special features:

1. By disposing the electronic module on the battery base of the rotating case, the electronic module is moved in conjunction when the earphone cables are pulled to drive the rotating case, avoiding tugging of the cables.

2. By passing the earphone cables through the cable apertures of the annular plate and the lateral wall, a storage solution for neatly storing extra lengths of the earphone cables is provided, reducing the need for precise lengths.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A wireless earphone comprising: a first fixing module (10) including a lower cover (11) and a fixing element (12), wherein the fixing element (12) is disposed at a central position of the lower cover (11); a rotating case (20) including a rotating base (21) and an upper cover (22), wherein the upper cover (22) is fixed to the rotating base (20), the rotating base (20) has a cup portion (211) and an annular plate (212) extending from the top edge of the cup portion (211), the fixing element (12) passes through the cup portion (211), and the rotating case (20) rotates about the fixing element (12); an electronic module (30) including a circuit board (31), a transceiver chip (32) and a battery (33), wherein the electronic module (30) is disposed between the upper cover (22) and the rotating base (20) and fixed to the annular plate (212); a tape spring (40), one end of which is attached to the cup portion (211) and the other end of which is attached to the fixing element (12); at least one earphone cable (50) wound around the cup portion (211) having one end extending to connect to the circuit board (31) and the other end passing through the lower cover (11); and a second fixing module (60) disposed between the rotating base (21) and the lower cover (11) for fixing the relative position between the rotating case (20) and the second fixing module (60).

2. The wireless earphone according to claim 1, wherein the cup portion (211) further comprises a lateral wall (2111) and a bottom face (2112), the lateral wall (2111) has multiple openings (2113), and the at least one earphone cable (50) respectively pass through the openings.

3. The wireless earphone according to claim 2, wherein an engagement piece (2116) is disposed on the bottom face (2112), the tape spring (40) is partially accommodated between the engagement piece (2116) and the lateral wall (2111), and one end of the tape spring (40) is fixed to one side of the engagement piece (2116).

4. The wireless earphone according to claim 2, wherein the annular plate (212) and the lateral wall (2111) each has a cable aperture (2123), and the earphone cable (50) passes through the cable aperture (2123) of the lateral wall (211) and the cable aperture (2117) of the annular plate (212).

5. The wireless earphone according to claim 2, wherein multiple protruding pieces (2114) are disposed on the bottom face (212), the multiple protruding pieces and the lateral wall (211) have a fixed gap distance between them, and the earphone cable (50) is engaged between the multiple protruding pieces (2114) and the lateral wall (211).

6. The wireless earphone according to claim 5, wherein at least one fixing unit (60) is disposed on the bottom face (212), the fixing unit (60) is engaged between multiple protruding pieces (2114), and the earphone cable (50) passes through and is fixed to the fixing unit (60).

7. The wireless earphone according to claim 1, wherein multiple first latches (2121) are disposed on the annular plate (212), a side of the upper cover facing the annular plate (212) has multiple second latches (2122) corresponding to the multiple first latches (2121).

8. The wireless earphone according to claim 1, wherein multiple battery bases (2122) are disposed on the annular plate (212), the battery (33) is disposed on the multiple battery bases (2122), the circuit board (31) is disposed on the battery (33), and the transceiver chip (32) is disposed between the battery (33) and the circuit board (31).

9. The wireless earphone according to claim 8, wherein the electronic module (30) further comprises at least one micro switch (34) disposed on the circuit board (31), and at least one key (222) corresponding to the micro switch (34) is disposed on the upper cover (20).

10. The wireless earphone according to claim 8, wherein the electronic module (30) further comprises a lighting unit (36) disposed on the circuit board (31), and a light passing aperture (224) corresponding to the lighting unit (36) is disposed on the upper cover (20).

11. The wireless earphone according to claim 8, wherein the electronic module (30) further comprises a microphone (37) disposed on the circuit board (31), and a sound receiving aperture (223) corresponding to the microphone (37) is disposed on the upper cover (20).

12. The wireless earphone according claim 1, wherein the fixing element (10) is a fixing column, the fixing column has an engagement groove (122), and one end of the tape spring (40) is attached to the engagement groove (122).

13. The wireless earphone according to claim 12, wherein a round plate (121) corresponding to an inner edge of the annular plate (212) is disposed on an end of the fixing column (12).

14. The wireless earphone according to claim 1, wherein the transceiver chip (32) is a Bluetooth chip.

* * * * *